US006196716B1

(12) United States Patent
Geyer

(10) Patent No.: US 6,196,716 B1
(45) Date of Patent: Mar. 6, 2001

(54) SIDE SEAL TAMPER INDICATING BAG

(75) Inventor: Thomas E. Geyer, West Chester, OH (US)

(73) Assignee: Amko Plastics Inc.

( * ) Notice: Subject to any disclaimer, the term of this patent is extended or adjusted under 35 U.S.C. 154(b) by 0 days.

(21) Appl. No.: 09/299,853

(22) Filed: Apr. 26, 1999

(51) Int. Cl.[7] ..... B65D 33/14

(52) U.S. Cl. ..... 383/5; 383/66; 383/84; 383/42

(58) Field of Search ..... 383/66, 5, 210, 383/211, 42, 84

(56) References Cited

U.S. PATENT DOCUMENTS

| | | | | |
|---|---|---|---|---|
| 3,717,244 | * | 2/1973 | Smith | 383/211 X |
| 3,942,713 | * | 3/1976 | Olson et al. | 383/66 X |
| 4,483,018 | | 11/1984 | Whelan . | |
| 4,509,196 | | 4/1985 | Sak et al. . | |
| 4,510,621 | | 4/1985 | Sak et al. . | |
| 4,709,396 | * | 11/1987 | Voshall et al. | 383/5 |
| 4,709,399 | * | 11/1987 | Sanders | 383/66 |
| 4,785,940 | | 11/1988 | Wilson . | |
| 4,786,190 | * | 11/1988 | Van Erden et al. | 383/66 X |
| 4,834,552 | | 5/1989 | Makowka . | |
| 4,925,316 | * | 5/1990 | Van Erden et al. | 383/210 X |
| 4,931,327 | | 6/1990 | Lin et al. . | |
| 4,932,791 | | 6/1990 | Vetter . | |
| 4,937,040 | | 6/1990 | Holcomb et al. . | |
| 4,941,196 | | 7/1990 | Edelman et al. . | |
| 4,988,547 | | 1/1991 | Voto, Jr. et al. . | |
| 5,056,930 | | 10/1991 | Mestetsky . | |
| 5,103,979 | * | 4/1992 | Hustad | 383/5 X |
| 5,135,313 | * | 8/1992 | Bowman | 383/5 |
| 5,167,455 | * | 12/1992 | Forman | 383/211 X |
| 5,287,960 | * | 2/1994 | Kalb et al. | 383/66 X |
| 5,348,400 | * | 9/1994 | Haiss et al. | 383/210 |
| 5,908,243 | * | 6/1999 | Hanning | 383/5 |

FOREIGN PATENT DOCUMENTS

| | | | | |
|---|---|---|---|---|
| B-17066/92 | | 12/1992 | (AU) . | |
| 302144 | * | 2/1989 | (EP) | 383/5 |
| 2238291 | | 5/1991 | (GB) . | |
| 2243143 | * | 10/1991 | (GB) | 383/5 |
| 2265883 | * | 10/1993 | (GB) | 383/5 |
| 91/041999 | * | 4/1991 | (WO) | 383/5 |
| WO91/15406 | | 10/1991 | (WO) . | |

OTHER PUBLICATIONS

Audit Secutiry Bags, Inc. Catalog, Tracer Bags on p. 7, 1998.*

* cited by examiner

*Primary Examiner*—Allan N. Shoap
*Assistant Examiner*—Robin Hylton
(74) *Attorney, Agent, or Firm*—Wood, Herron & Evans LLP

(57) ABSTRACT

A tamper indicating bag is formed by cutting a perforation along a sheet which is subsequently folded over and sealed along two sides and the top edge. The fold is made so that one of the walls of the bag is longer than the other and the heat seal is applied above the perforation which in turn forms a flap in the wider sheet. Printing is applied to the flap as well as above and below the perforation and a tamper indicating adhesive is then applied to the flap. The bag can be opened by separating the perforated opening and contents placed in the bag. The flap is then folded over the opening sealing it and providing a tamper indicating seal.

5 Claims, 3 Drawing Sheets

SIDE SEAL TAMPER INDICATING BAG

BACKGROUND

Tamper indicating bags are used to transfer valuable or sensitive contents. These are usually plastic bags which provide some type of indication if the bag has been opened in transit. Thus, from the point of sealing to the point of delivery, no one should be able to access the bag and remove its contents without being discovered.

There are many different tamper indicating bags. Most of these have openings in the top edge of the bag with an upper flap which can be folded over and adhere to the bag closing the opening. Exemplary bags are disclosed in Whelan, U.S. Pat. No. 4,483,018, Sack et al., U.S. Pat. No. 4,509,196, Sack, U.S. Pat. No. 4,510,621, Wilson, U.S. Pat. No. 4,785,940, Voto, U.S. Pat. No. 4,988,547, Edelman et al., U.S. Pat. No. 4,941,196, Makrauer, U.S. Pat. No. 5,620,256.

Generally the adhesive on the upper flap has some type of printing beneath it. Thus, if someone tries to pull the flap from the bag, frequently using refrigerants to make the adhesive brittle, it will pull the printing off and be detectable.

Frequently these flaps are separately formed and welded to the upper portion of the bag. Alternately the bag itself can be formed with a flap portion which is subsequently coated with an adhesive. These separately formed flaps are expensive relative to the cost of the bag.

Further, a thief can frequently access the contents of a bag through a very small opening that might remain at the very top. Thus, with top-opening bags, if the bag is not properly sealed, it will not be tamper-proof.

A side seal bag is disclosed in WO-91/15406 entitled Security Bag Sealed by Silicone Rubber Adhesive. This reference discloses a side seal bag which is formed by folding a sheet of plastic on itself to form a front side and a rear side. The rear side is longer than the front side and provides an upper flap. A slit is formed in the front side below the top edge to form a side opening bag. Adhesive on the flap is designed to cover the opening. There is also a layer of printing immediately below where the adhesive would contact the pouch. Thus if someone were to use solvent to access the contents, they would dissolve a portion of the printing, thereby being detected.

This reference fails to disclose any method of manufacturing the bag. Further there is no disclosure of forming any indicia over the opening itself where the adhesive would bond to the bag. This is quite critical but is obviously problematic with a side seal bag where the adhesive is designed to cover both above and below the opening. The bag disclosed in this reference would fail to detect a refrigerant used to disable the adhesive.

SUMMARY OF THE INVENTION

The present invention is premised upon the realization that a side seal bag can be formed by folding a sheet of plastic onto itself and forming two side seals and an upper seal with a flap portion remaining above the upper seal. A perforation is formed on the same side of the sheet as the flap slightly below the top seal. The flap portion as well as the area around the opening is not treated with an electrostatic discharge or other adhesion promoting process whereas the remaining portion of the bag is. Indicia or ink is applied to the upper flap and around the perforated opening and adhesive applied to the upper flap.

To use the bag the perforated opening is pulled apart to provide an opening and items are placed in the bag. A protective strip is removed from the adhesive and the flap folded over the opening sealing the bag. If anyone attempts to open the bag using refrigerants, solvents or the like, they will disturb the indicia on both the upper flap and from around the opening.

The present invention provides a unique method of forming a plastic bag which prevents detection and further significantly reduces the cost of manufacturing the bag. Further objects and advantages of the present invention will be appreciated in light of the following detailed descriptions and drawings in which:

DETAILED DESCRIPTION

Figure 1:
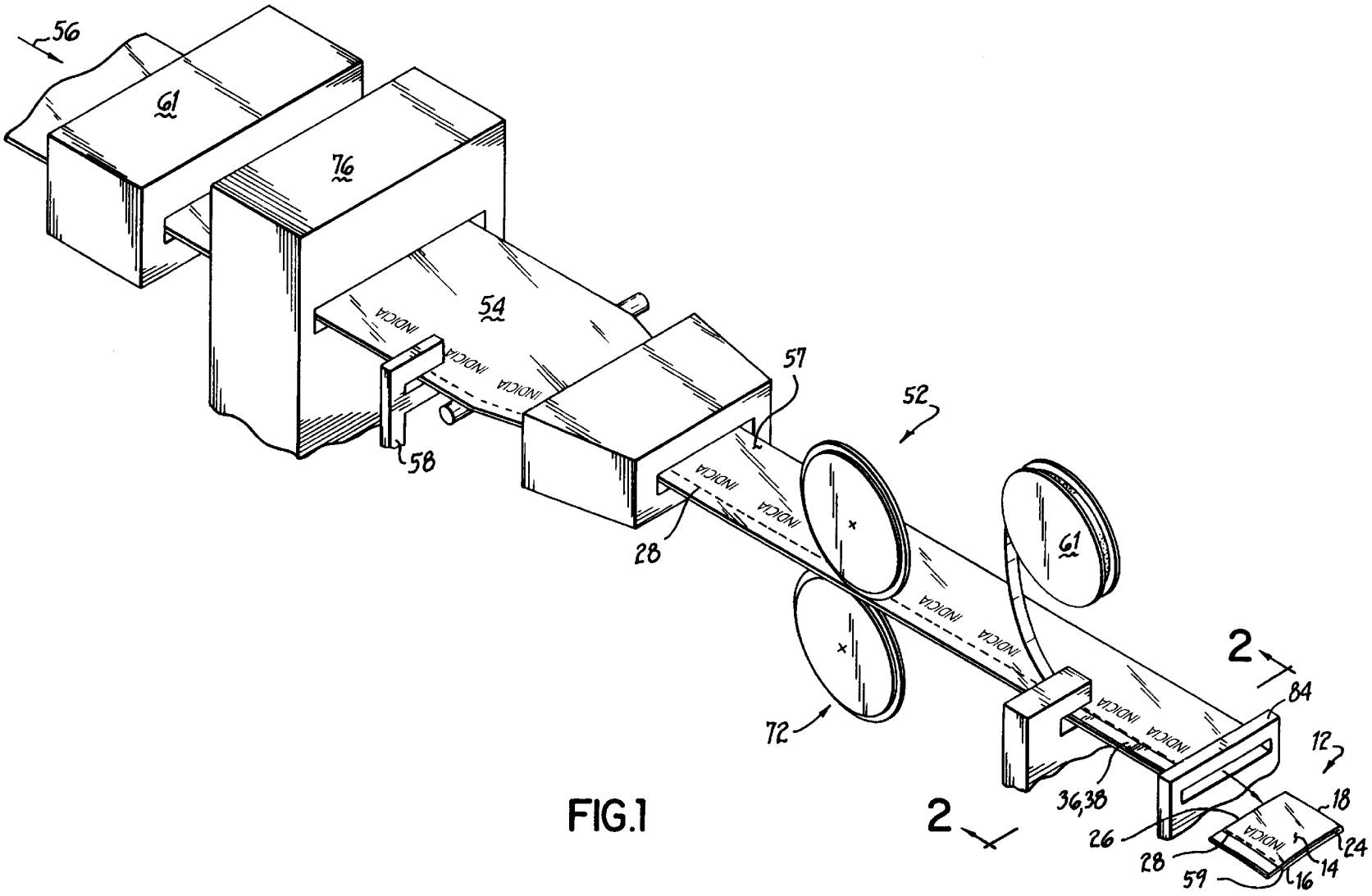
FIG. 1 is a diagrammatic depiction of the process of manufacturing bags according to the present invention.
Figure 2:
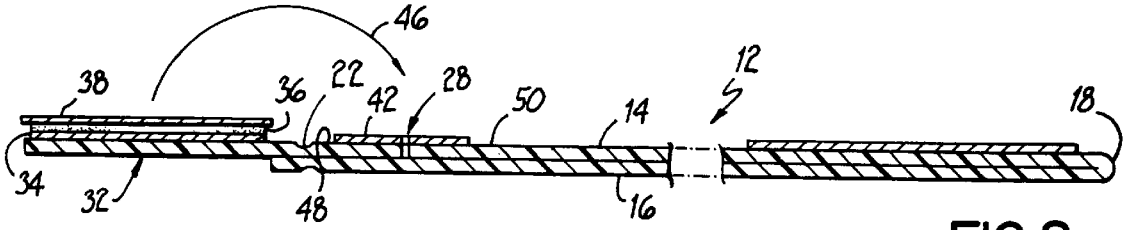
FIG. 2 is a cross-sectional view taken at lines 2—2 of FIG. 1.

The present invention is a security bag 12 which includes a first or front opening wall 14 and a second wall 16 connected at a fold 18. The bag 12 further includes a top seal 22 and a first side seal 24 and second side seal 26. When initially formed the bag includes a perforated opening 28 in the first wall 14 slightly below the top seal 22, generally about ¾ of an inch to an inch below the top seal. Above the top seal and formed from part of the first wall 14 is flap 32.

Flexo printing with water based ink 34 covers the top flap 32. In turn the printing 34 is coated with an adhesive 36 and subsequently by a release strip 38. Tamper evident adhesives are sold by a number of different companies. Included in these are: H. B. Fuller Co., Collano, ATO Findley and Novamelt USA, Inc. Further the ink used to print the bag can likewise be purchased from a number of different sources such as INX International Ink Co., Sun Chemical and Flint Ink Corporation.

Figure 5:
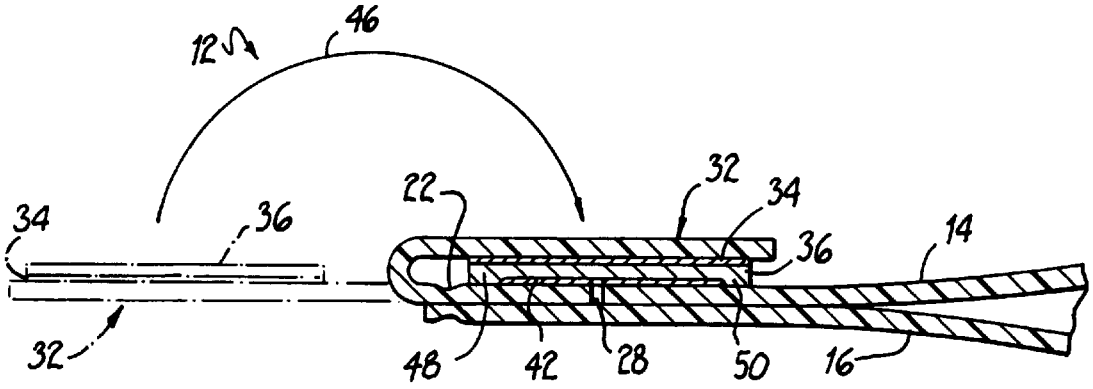
FIG. 5 is a cross-sectional view taken at lines 5—5 of FIG. 4 showing the bag open in phantom and closed in solid.

Printing 42 (water based ink) is also applied to the area immediately above and below the perforated opening 28. In other words, it is applied in areas which will be contacted by adhesive 36 when flap 42 is folded over as shown in FIG. 5. This printing 42 can be, for example, simply a solid stripe above and below the perforated opening. Generally the printing 42 will be narrower than the adhesive layer 36 on flap 32.

Figure 3:
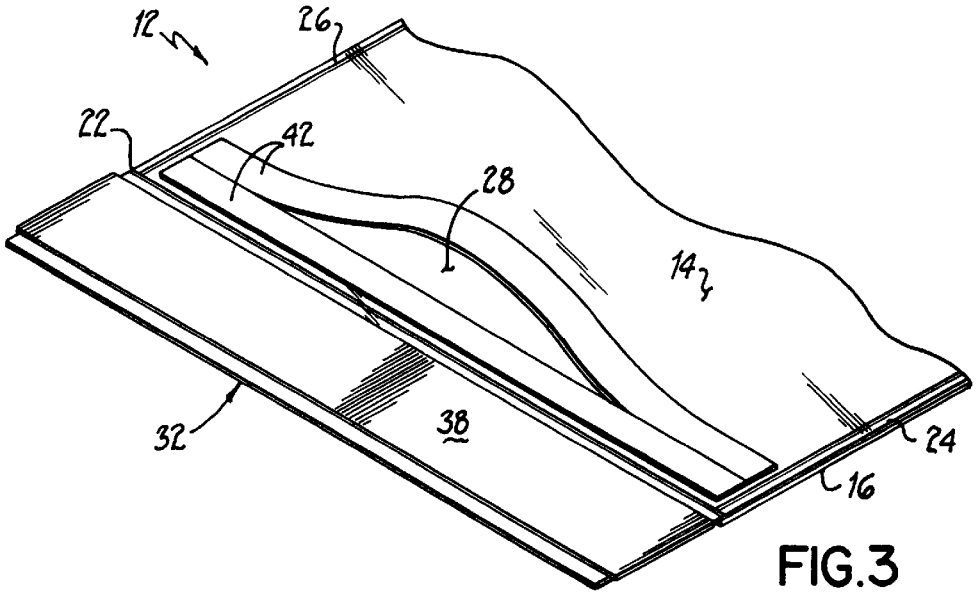
FIG. 3 is a perspective view broken away of a bag formed according to the present invention.
Figure 4:
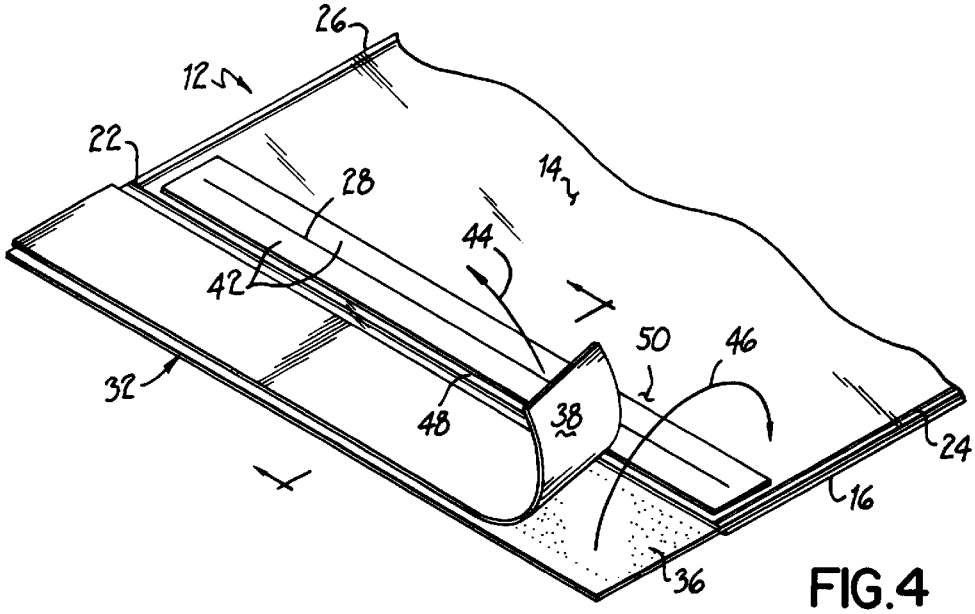
FIG. 4 is the same perspective view shown in FIG. 3 demonstrating sealing the bag.

To utilize the bag of the present invention, the perforated opening 28 is pulled open as shown in FIG. 3 and items (not shown) are placed in the bag 12. The release strip 38 is removed as shown by arrow 44 and the flap 32 is folded over the perforated opening 28 as indicated by arrow 46. The adhesive will cover the printing 42 and adhere to the first wall 14 and above and below the printing 42 at areas 48 and 50. Thus the adhesive adheres not only to the indicia 42 but also to the bag itself. This completely seals the opening preventing access. If one pulls the flap from the first wall 14, they will pull up printing 42 and/or 34. It is almost impossible to reposition the flap with the printing in an undisturbed state.

As shown more particularly in FIG. 1, the bag 12 of the present invention can be formed easily and inexpensively.

As shown in FIG. 1, the apparatus 52 includes a source of film 54 moving in the direction of arrow 56. An electrostatic charge or other adhesion promoting treatment is applied to the film at station 61. The adhesion promoting treatment is applied only from the fold 18 up to the area where the printing will be applied adjacent the perforated opening 28, in other words, about an inch below the perforated opening 28. Thus, the adhesion promoting treatment is not applied on the area immediately on either side of the opening 28 nor on the top flap 32. The bottom layer 59 which becomes second wall 16 can be fully treated if desired. Next, the folded film travels through a printing press diagrammatically shown as 76 in FIG. 1 where indicia or printing can be applied over any area of the bag, but in particular on the top flap 32 and on either side of the opening 28. The application of the electrostatic charge and the printing can be done separately i.e., in a noncontinuous process. The film is pulled through a perforator 58 which will form the perforated opening 28 in bag 12. Film 54 is folded, providing the bottom fold line 18. Fold 18 divides the film into a top layer 57 which is wider than the bottom layer 59.

Next the folded film is pulled down the apparatus where a heating device 72 forms the top seal 22. This, in effect, creates the top flap 32.

Next a layer of adhesive 34 is applied to the upper flap 32.

This adhesive 36 is pre-applied to a release strip 38 and is supplied from roll 61. The exposed surface of the adhesive 36 is pressed against the flap 32 with the release strip 38 covering the adhesive preventing it from inadvertently adhering to something. Finally the side seals are formed and the bag cut by a heated cutter 84 and the individual bags discharged as indicated by arrow 86.

It may be preferable to form an upper most flap not shown attached to top flap 32 by a perforation line. This can be printed with a sequential number which is also printed on the bag. The upper flap can be torn off and retained as a receipt. This is optional and is a common feature in security bags.

The present invention provides numerous advantages not only in terms of performance of the security bag itself but also in the manufacture of the security bag. Because the flap and the opening are both formed from the same side, the manufacture of the bag is simplified.

The present invention enables the flap to be formed from the pouch itself without the need for a separate adhesive coated flap. Further the method of forming the bag facilitates forming an electrostatic adhesion promoting charge onto limited portions of the bag leaving the opening of the bag and the flap untreated. Thus the printing or ink applied at these areas is only weakly bound to the bag. Further by applying ink above and below the side seal opening, tamper indication is further enhanced. If ink was not applied above and below the opening, one could theoretically freeze the adhesive lying either above or below the opening and gain access through this area.

Forming the opening as a perforated opening as opposed to a cut opening simplifies manufacturing, including printing. Thus, the present invention not only forms a very effective tamper indicating bag but it also provides a very simple method of manufacturing the bag that significantly reduces cost without affecting performance.

This has been a description of the present invention and the preferred mode of practicing the invention, however, the invention should be defined by the appended claims wherein I claim:

1. A tamper indicating bag comprising a first wall and a second wall having a bottom edge joining the first and second wall wherein said first wall is longer than said second wall;

a first and a second side seal and a top seal opposite said bottom edge bonding said first wall and said second wall;

said first wall having a flap above said top seal and an opening slit below said top seal;

a tamper indicating printing on one of said flap and an area immediately adjacent said opening slit;

a tamper resistant adhesive on said flap, said flap adapted to fold over and cover said opening with said adhesive.

2. The tamper indicating bag claimed in claim 1 wherein said first wall and said second wall are joined together at a fold.

3. The tamper indicating bag claimed in claim 1 wherein printing is applied on said area immediately adjacent said opening slit.

4. The tamper indicating bag claimed in claim 1 wherein said opening slit is a perforated opening slit.

5. The tamper indicating bag claimed in claim 1 wherein said first wall is only partially treated with an adhesion promoting treatment and wherein said flap and said area immediately adjacent said slit opening are not treated with an adhesion promoting treatment.

* * * * *